US005927224A

United States Patent [19]

Etheridge et al.

[11] Patent Number: 5,927,224

[45] Date of Patent: Jul. 27, 1999

[54] DUAL FUNCTION MOORING LINES FOR STORAGE VESSEL

[75] Inventors: Charles O. Etheridge, Spring; Peter F. Poranski, Sr., Houston, both of Tex.

[73] Assignee: FMC Corporation, Chicago, Ill.

[21] Appl. No.: 08/856,965

[22] Filed: May 15, 1997

Related U.S. Application Data

[60] Provisional application No. 60/020,005, Jun. 21, 1996.

[51] Int. Cl.[6] ..... B63B 21/50

[52] U.S. Cl. ..... 114/230.1

[58] Field of Search ..... 441/3–5; 114/230; 405/224.2, 224.3, 224.4; 138/144

[56] References Cited

U.S. PATENT DOCUMENTS

| | | | |
|---|---|---|---|
| 3,447,554 | 6/1969 | Josephson . | |
| 3,595,278 | 7/1971 | Lilly, Jr. et al. | 114/230 |
| 3,728,748 | 4/1973 | Roehler . | |
| 3,834,432 | 9/1974 | Lilly et al. . | |
| 3,858,401 | 1/1975 | Watkins | 405/224.2 |
| 4,173,804 | 11/1979 | Duc . | |
| 4,351,364 | 9/1982 | Cocks | 138/144 |
| 4,478,586 | 10/1984 | Gentry et al. . | |
| 4,546,721 | 10/1985 | Langrock . | |
| 4,597,595 | 7/1986 | Wallace . | |
| 4,634,314 | 1/1987 | Pierce | 405/224.2 |
| 4,637,335 | 1/1987 | Pollack | 114/230 |
| 4,721,053 | 1/1988 | Brewerton . | |
| 4,728,224 | 3/1988 | Salama et al. | 405/224.2 |
| 4,802,431 | 2/1989 | Pollack | 114/230 |
| 4,903,735 | 2/1990 | Delacour et al. | 138/144 |
| 5,306,186 | 4/1994 | Boatman . | |
| 5,316,509 | 5/1994 | Boatman et al. . | |
| 5,427,046 | 6/1995 | Brown et al. . | |
| 5,447,114 | 9/1995 | Korsgaard . | |

FOREIGN PATENT DOCUMENTS

| | | | |
|---|---|---|---|
| 83688 | 6/1980 | Japan | 441/4 |

*Primary Examiner*—Sherman Basinger
*Attorney, Agent, or Firm*—Bush, Riddle & Jackson, L.L.P.

[57] ABSTRACT

An improved vessel mooring system in which a storage vessel (10) weathervanes about a mooring base (16, 27) supported by the vessel for relative rotation. A plurality of flexible tubular dual function mooring lines (20) extend from the mooring base (27) to the sea floor (14) and thence to a subsea production facility (40). The dual function mooring lines (20) have collars (34) thereon which are anchored to the sea floor (14) by anchors (38). Product from a subsea production facility (40) is transported through the dual function mooring lines (20) to storage areas in the vessel (10).

12 Claims, 3 Drawing Sheets

DUAL FUNCTION MOORING LINES FOR STORAGE VESSEL

CROSS-REFERENCE TO RELATED PROVISIONAL APPLICATION

This application claims the benefit of U.S. Provisional Application No. 60/020,005 filed Jun. 21, 1996 and entitled Mooring Lines For Storage Vessels.

BACKGROUND OF THE INVENTION

1. Field of the Invention

This invention relates generally to a mooring system for floating storage vessels, and more particularly to mooring lines for floating storage vessels which may be used simultaneously for the transfer of fluid product.

2. Description of the Prior Art

Floating storage vessels for petroleum products are normally moored in the sea by mooring lines anchored to the sea bed. The mooring lines are normally secured to a turret mounted in a moon pool or opening in the vessel so that the vessel may rotate or "weathervane" about the turret. Separate risers extend from subsea wells or manifolds to the storage vessel for the flow of product from the subsea wells to the storage vessel. The risers are flexible and are connected to corresponding piping in the turret which extends to a manifold. A swivel stack is provided on the vessel with a separate product line from the turret manifold extending to a swivel chamber of each swivel for product supply to storage holds in the vessel. As examples of turrets, reference is made to U.S. Pat. No. 4,698,038 dated Oct. 6, 1987 and 5,306,186 dated Apr. 26, 1994, which are incorporated herein as a written description for all purposes. In regard to swivel stacks, reference is made to U.S. Pat. No. 4,306,741 dated Dec. 22, 1981 and 4,647,077 dated Mar. 3, 1987, which are incorporated herein as a written description for all purposes.

It is becoming commonly accepted practice for floating vessels (tankers, barges, column stabilized units, etc.) to be moored in the open ocean using spread or single point type mooring systems. This is being done using various combinations of chain, wire rope and polyester rope in conjunction with subsurface support buoys to provide mooring systems that are uniquely customized for a specific vessel and environmental conditions at a given site. In some cases, dynamic positioning using controlled thrusters may be used to augment the mooring system. Anchoring to the sea floor is normally done by use of drag imbedment anchors or anchor piles depending upon the sea bed soil conditions.

Such moored vessels are then outfitted with the mechanical equipment to receive and/or send the full range of petroleum related products from the sea floor to the vessel. The vessel and its equipment is then used for storage, processing and off loading by either transfer to other floating vessels or back to flowlines on the sea floor. For the diverse offshore oilfields located around the world, there tends to be a large number of flowline risers required between the turret and the sea floor. Systems are currently being manufactured and installed that have four (4), eight (8) or even as many as thirty (30) flowline risers.

SUMMARY OF THE INVENTION

The present invention is directed to dual function mooring lines in a mooring system for production vessels which may be used for transferring product in addition to mooring the vessel, thereby eliminating the need for any separate risers.

The mooring lines are tubular to define a hollow space thereby simultaneously capable of serving as flowlines to provide a flow path for product under pressure. The tubular dual function mooring lines are of a strength and size to provide restoring forces necessary to moor the vessel. They are normally connected to a turret which is rotatably supported within a moon pool of the vessel so that the vessel can weathervane about the turret.

Thus, a primary object of the present invention is to provide a mooring system for floating storage vessels which have the tubular dual function mooring lines capable of being anchored to the sea bed and mooring a vessel and also capable of functioning as a flow line or riser for the flow of product from the sea bed to the storage vessel.

DESCRIPTION OF THE INVENTION

Figure 1:
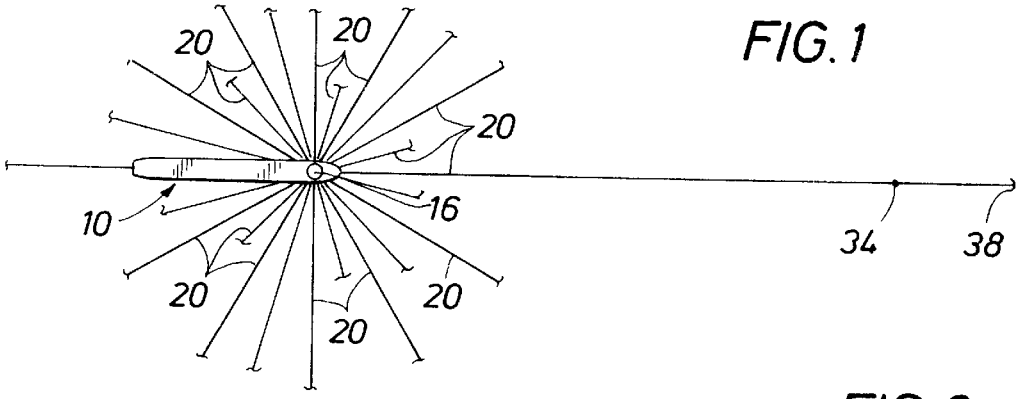
FIG. 1 is a schematic plan view illustrating a mooring system of the present invention in which a plurality of dual function mooring lines for a storage vessel are formed of a tubular construction to function also as a product flow passage.
Figure 2:
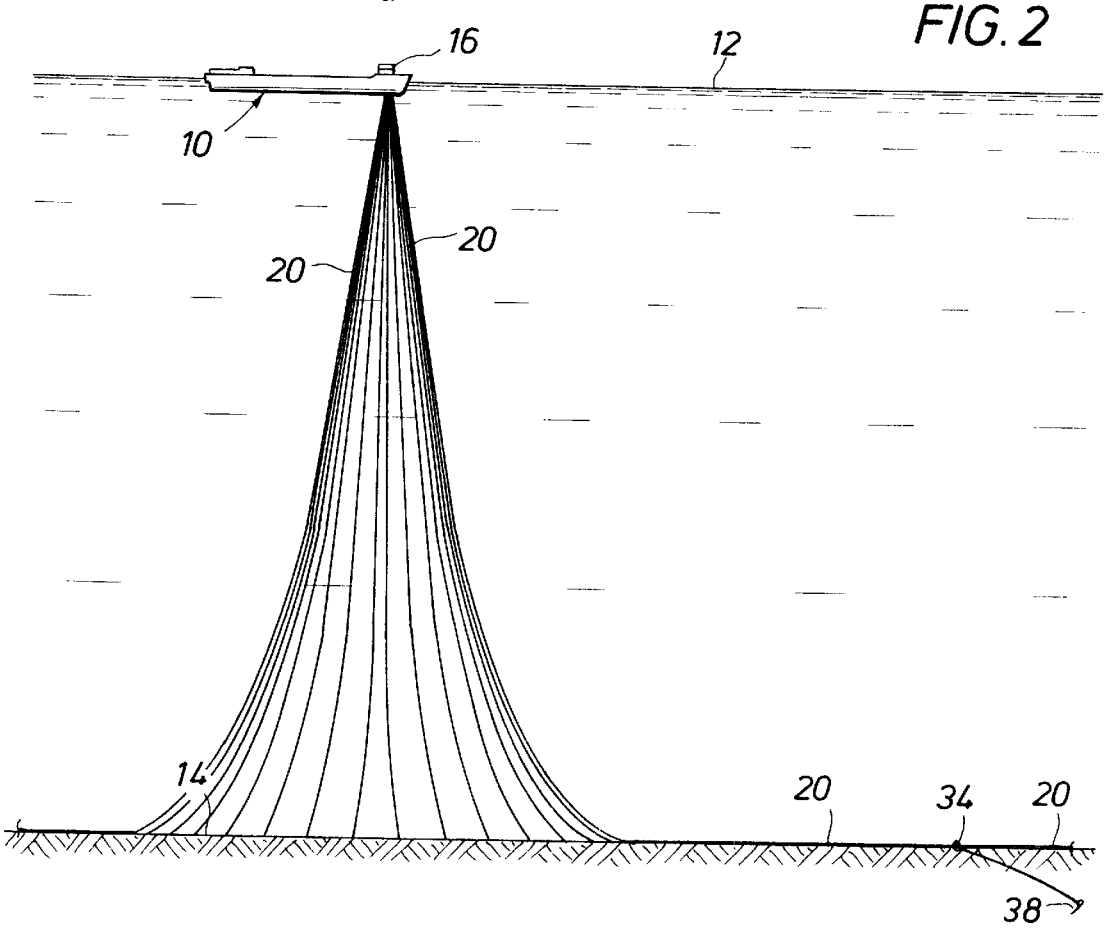
FIG. 2 is a schematic elevation view of the mooring system shown in FIG. 1.

Referring to the drawings, a storage vessel 10 is shown floating on a sea surface 12. The sea bed or sea bottom is indicated at 14. A turret 16 is mounted within a moon pool 18 at the bow of vessel 10. Turret 16 has an upper overhanging portion 25 mounted for relative rotation on suitable bearings 26. Cushioned radial bearings 28 are mounted on the vessel structure adjacent moon pool 18. As shown in FIG. 1, a plurality of tubular dual function mooring lines 20 are arranged peripherally in an array about turret 16.

Figure 3:
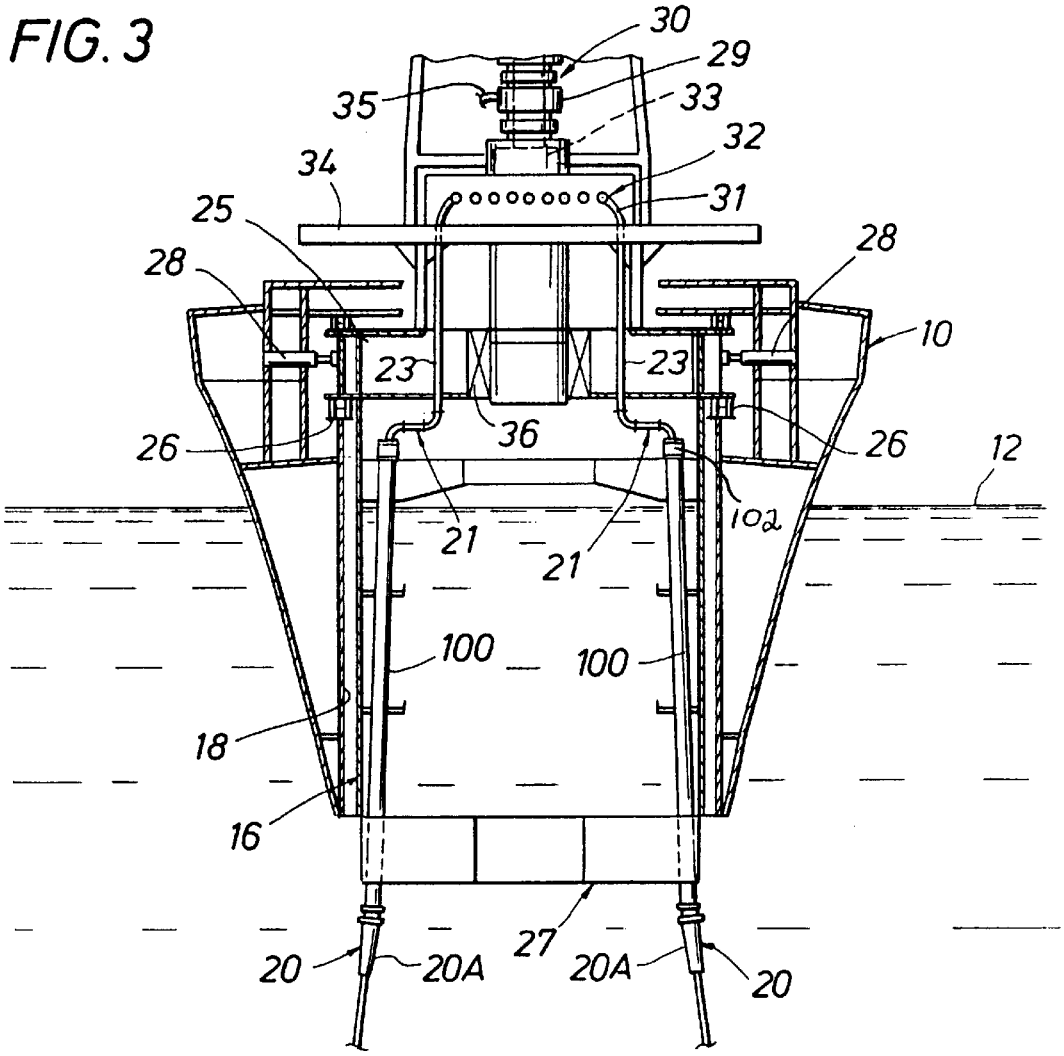
FIG. 3 is a sectional view of a floating storage vessel having a turret mounted in a moon pool of the vessel and anchored by tubular dual function mooring lines comprising the present invention.

As shown in FIG. 3, each flexible dual function mooring line 20 is inserted in a bend restrictor 20A at the lower end 27 of the turret 16, and continues upwardly through structural tubes 100 which encase the risers 20 in the turret 16. The risers 20 are supported above the waterline 12 by support blocks 102. A slip is set in each support block 102 to support the flexible dual function mooring line 20 to the turret. Piping 21 is connected at the upper end of each riser 20 by a standard flange, clamp connector or a QC/DC fitting. Fixed piping 21 is connected to upper piping 23 which extends to manifold 32. Manifolds 32 are mounted on manifold deck 34 which forms part of turret 16. The vessel 10 rotates about turret 16 on vertical bearings 26 and is rotationally cushioned by radial bearings 28.

Figure 4:
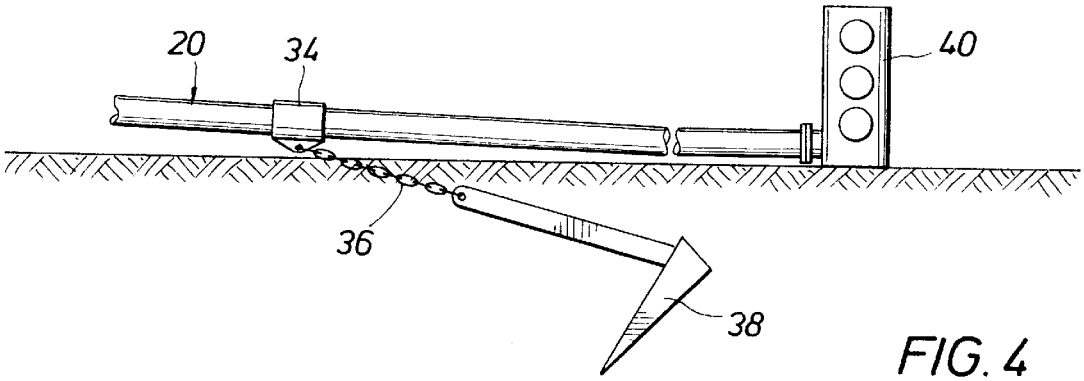
FIG. 4 is an enlarged cross sectional view, partly schematic, of the anchor means for securing the dual function mooring lines to the sea floor.

A swivel stack 30 is mounted above manifolds 32. Swivel stack 30 may include an inner ring structure 33 which is fixed to turret 16 and has a stationary concentric outer ring structure 29 which is fixed to and rotates with vessel 10 about turret 16. Each outer ring of the swivel stack 30 is rotationally coupled to its corresponding inner ring. An auxiliary bearing 36 may be provided to provide additional rotation coupling of the outer rings of the swivel stack to the turret 16. Suitable product flowlines are connected to suitable valves on manifolds 32 and extend within inner ring structure 33. Flowlines 35 are connected to stationary ring structure 29 for the flow of product from swivel stack 30 to suitable holds or storage areas in storage vessel 10. Reference is made to aforementioned U.S. Pat. Nos. 4,306,741 and 4,647,077 for a description of swivel stacks. As shown in FIG. 4, a lower end portion of each dual function mooring line 20 has a collar or coupling 34 connected by a chain 36 to an anchor 38 extending therefrom and embedded in the sea bed 14. While anchor 38 is shown as an embedment type anchor, other anchors or a suitable fixed piling may be provided. Tubular dual function mooring line 20 extends from collar 34 to a subsea manifold or subsea production facility indicated schematically at 40. Such facility may be a subsea wellhead or manifold. Mooring line 20 functions not only to secure the turret 16 to the sea floor 14 but also to transport fluid product from subsea wells to the storage or processing vessel 10.

Tubular mooring/product line 20 is required to be of sufficient strength and size for anchoring vessel 10 in addition to providing a suitable flow conduit for transport of product from seabed 14 to vessel 10. Tubular dual function mooring line 20 is preferably formed of a composite flexible pipe made of a plurality of thermoplastic and steel layers having a considerable tensile strength and resisting internal fluid pressure loading. The thermoplastic layers make the flexible dual function mooring line 20 leakproof against internal and external fluid while the steel layers resist pressure (internal and external) and axial loads. The arrangement and design of such layers is provided to match the precise combination of pressures and axial loads that may occur. In addition, other combinations of material could be used in order to alter the submerged weight of the flexible pipe to improve its characteristics for use in the catenaries associated with a mooring system.

An example of dual function mooring line 20 is illustrated generally in FIG. 5 in which separate layers 20B–20H form a composite pipe structure. Inner layer 20B is a carcass formed of interlocked steel strips. Adjacent layer 20C is a thermoplastic pressure sheath. Intermediate layer 20D is a spiral layer of interlocked steel strips. Intermediate layer 20E is a flat steel spiral layer. Intermediate layers 20F and 20G are cross wound flat steel spiral layer of armor wires. Outer layer 20H is an external thermoplastic protective sheath. Flexible mooring product line 20 could be formed satisfactorily of various layers of metal and thermoplastics dependent on the design parameters.

Figure 5A:
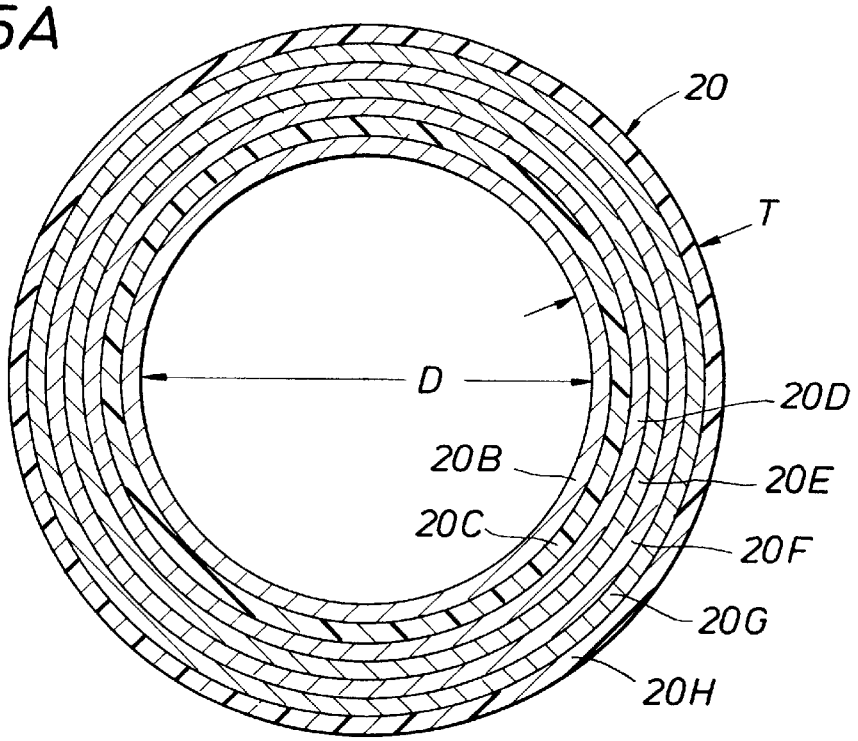
FIGS. 5A and 5B are enlarged cross sectional views of a tubular dual function mooring line illustrating the present invention.

The tubular wall of flexible tubular dual function mooring line 20 has an inner diameter D and wall thickness T as shown in FIG. 5A. Diameter D may, for example, may be six (6) inches and thickness T may be one (1) inch. Diameter D and thickness T are designed and arranged to provide the proper strength and weight for each predetermined diameter and desired flow characteristic. The flexible dual function mooring line 20 is designed and arranged to produce spring force characteristics necessary to produce satisfactory mooring loads that are expected to occur in combination with the internal pressures expected of the fluid product inside the mooring/product line 20 and the pressure of the sea outside mooring/product line.

Figure 5B:
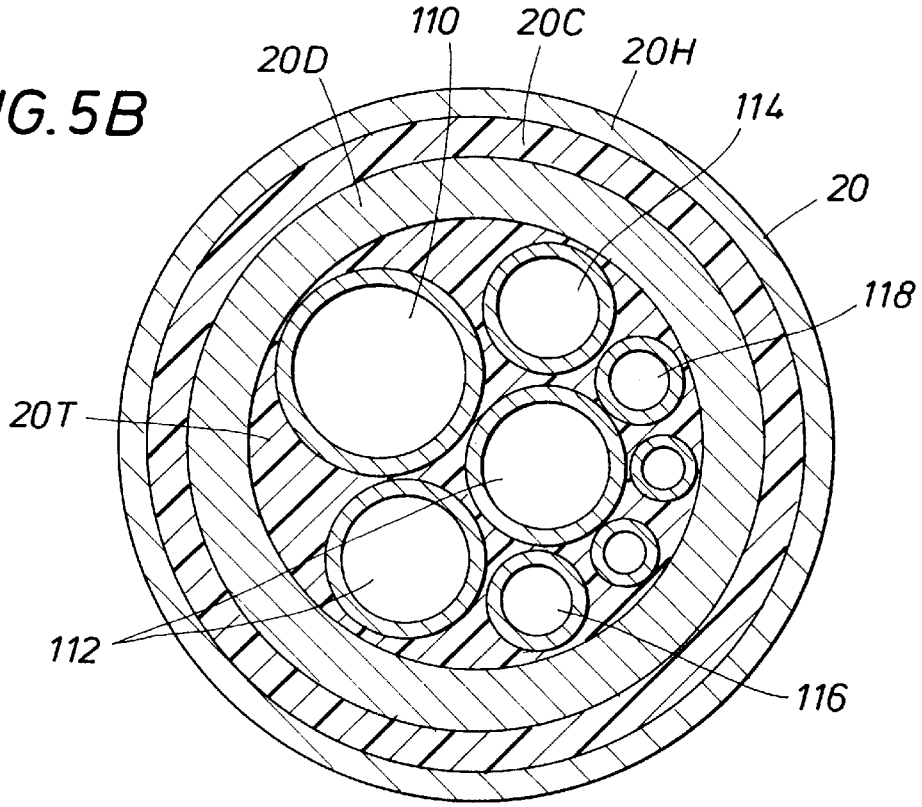

It may be desirable in some instances to use tubular dual function mooring line 20 to receive other umbilicals providing electricity, hydraulic pressure, or well treatment fluid paths to equipment on the sea floor 14 from the turret 16. FIG. 5B illustrates a flexible tubular dual function mooring line 20 which includes conduit 110 for transfer of product through line 20, conduits 112 for pressurized hydraulic fluid to a subsea well, conduit 114 for electrical power to a subsea XMAS tree, conduit 116 for electrical/fiber optic control and data lines, and conduits 118 for well treatment fluids. The conduits of FIG. 5B are embedded in thermoplastic material 20T.

While the embodiment of the present invention has been described for a vessel mounted for rotation about a turret substantially fixed to the sea floor, it is apparent that this invention may find application for any mooring line associated with a vessel in which it is desired to achieve the additional function of transferring fluid product from the sea floor to the vessel. For example, dual function mooring lines as described above may run from a loading buoy to the sea floor to transport product from the sea floor to a surface location.

While the invention has been described in the more limited aspects of a preferred embodiment thereof, other embodiments have been suggested and still others will occur to those skilled in the art upon a reading and understanding of the foregoing specification. It is intended that all such embodiments be included within the scope of this invention as limited only by the appended claims.

What is claimed is:

1. An improved vessel mooring system including a vessel having product lines thereon which extend to a storage are of the vessel and a plurality of improved dual function mooring lines connected to said vessel and anchored to the sea floor for maintaining the vessel at a predetermined location, said plurality of dual function mooring lines functioning simultaneously partially to moor the vessel in combination with other dual function mooring lines and to provide a fluid product flowline between the vessel and the sea bed, each of said dual function mooring lines being tubular in shape and designed and arranged to provide a fluid flow path within its tubular shape, each of said dual function mooring lines having a lower end extending to the sea floor and anchored thereto and being in fluid communication with a subsea fluid product installation at the sea floor and having an upper end coupled with a product line at said vessel whereby each of said mooring lines simultaneously functions at least partially to moor said vessel and to transfer fluid product between said subsea fluid product installation and said storage area of said vessel.

2. The improved system of claim 1 wherein:

a turret is rotationally coupled to said vessel and disposed within a vertical opening of the vessel, said turret including a plurality of conduits disposed thereon each of which is in fluid communication with a product line on said vessel, each of said dual function mooring lines secured to said turret to at least partially moor said vessel to the sea floor, each of said dual function mooring lines having a fluid coupling to said conduit of said turret.

3. The improved system in claim 1 wherein:

a securing collar is mounted about said dual function mooring line adjacent the sea floor; and an anchor means on said sea floor is connected to the securing collar for maintaining said dual function mooring line thereon, said dual function mooring line extending from said anchor means to said subsea fluid product installation for the supply of product thereat.

4. The improved system of claim 1 wherein:

said dual function mooring line has an annular wall including a plurality of thermoplastic layers and a plurality of steel layers separating said thermoplastic layers.

5. The improved system of claim 4 wherein:

said plurality of steel layers are characterized by a plurality of spirally wound interlocking steel strands.

6. The improved system of claim 4 wherein:

a hydraulic fluid line is positioned within said dual function mooring line.

7. The improved system of claim 1 wherein:

an electrical cable is positioned within said dual function mooring line.

8. An improved mooring arrangement for a vessel comprising:

a mooring structure rotationally coupled with said vessel, a plurality of flexible tubular dual function mooring lines connected to said mooring structure and having lower end portions extending to subsea production facilities on a sea floor for fluid communication of product between said subsea production facilities and said mooring structure, and anchor means for anchoring said lower end portions of said plurality of dual function mooring lines to said sea floor for transmitting of mooring loads from said mooring structure to said sea floor through said mooring lines for mooring of said mooring structure.

9. The improved mooring arrangement of claim 8 wherein:

product lines on said vessel are in fluid communication with said mooring lines on said mooring structure to storage areas in said vessel for the transport of product to said storage areas.

10. The improved mooring arrangement of claim 9 wherein:

a support collar is mounted about each dual function mooring line adjacent the sea floor; and said anchor means are anchored to the sea floor and connected to said support collars for anchoring the mooring lines to said sea floor.

11. The improved mooring arrangement of claim 8 wherein:

each of said dual function mooring lines has an annular wall including a plurality of thermoplastic layers and a plurality of spirally wound steel layers separating said thermoplastic layers.

12. An improved mooring arrangement of claim 8 wherein:

a hydraulic fluid line is positioned within at least one of said tubular mooring lines.

* * * * *